US010699650B1

(12) United States Patent
Xi et al.

(10) Patent No.: US 10,699,650 B1
(45) Date of Patent: Jun. 30, 2020

(54) DRIVING METHOD FOR ELECTROWETTING PANELS

(71) Applicant: Shanghai AVIC OPTO Electronics Co., Ltd., Shanghai (CN)

(72) Inventors: Kerui Xi, Shanghai (CN); Feng Qin, Shanghai (CN); Jine Liu, Shanghai (CN); Xiaohe Li, Shanghai (CN); Tingting Cui, Shanghai (CN); Yuan Ding, Shanghai (CN)

(73) Assignee: SHANGHAI AVIC OPTO ELECTRONICS CO., LTD., Shanghai (CN)

( * ) Notice: Subject to any disclaimer, the term of this patent is extended or adjusted under 35 U.S.C. 154(b) by 0 days.

(21) Appl. No.: 16/441,668

(22) Filed: Jun. 14, 2019

(30) Foreign Application Priority Data

Mar. 29, 2019 (CN) ..... 2019 1 0253007

(51) Int. Cl.
*G09G 3/34* (2006.01)

(52) U.S. Cl.
CPC ..... *G09G 3/348* (2013.01); *G09G 2300/043* (2013.01); *G09G 2300/0426* (2013.01)

(58) Field of Classification Search
CPC ..... G09G 3/348
See application file for complete search history.

(56) References Cited

U.S. PATENT DOCUMENTS

2010/0149150 A1* 6/2010 Chen ..... G09G 3/3433 345/211
2011/0254816 A1* 10/2011 Umezaki ..... G09G 3/344 345/204

(Continued)

FOREIGN PATENT DOCUMENTS

CN 107617451 A 1/2018

*Primary Examiner* — Sanghyuk Park
(74) *Attorney, Agent, or Firm* — Anova Law Group PLLC

(57) ABSTRACT

A driving method for an electrowetting panel is provided. The electrowetting panel includes M driving electrodes sequentially arranged along a first direction. The driving method includes providing electrical signals to the M driving electrodes, such that a droplet is acquired from a solution reservoir by the $1^{st}$ driving electrode, and is driven to move by the M driving electrodes. During a droplet moving period, a pulse width of a driving signal of an $m^{th}$ driving electrode is $$Wm = \sum_{i=1}^{m} W_i,$$

a pulse width of a non-driving signal between an $a^{th}$ driving signal and an $(a+1)^{th}$ driving signal of the $m^{th}$ driving electrode is $$Zma = \sum_{i=m+1}^{m+a} W_i.$$

M, m, and a are positive integers, $1 \le m \le M$, and $M \ge 3$. The end time of the $1^{st}$ driving signal of the $m^{th}$ driving electrode and the end time of the $m^{th}$ driving signal of the $1^{st}$ driving electrode are the same.

15 Claims, 18 Drawing Sheets

(56) References Cited

U.S. PATENT DOCUMENTS

| | | | | |
|---|---|---|---|---|
| 2013/0009938 | A1* | 1/2013 | Hwang | G09G 3/348<br>345/212 |
| 2013/0235090 | A1* | 9/2013 | Choi | H05B 45/46<br>345/690 |
| 2016/0267872 | A1* | 9/2016 | Park | G09G 3/3688 |

* cited by examiner

DRIVING METHOD FOR ELECTROWETTING PANELS

CROSS-REFERENCES TO RELATED APPLICATIONS

This application claims the priority of Chinese patent application No. 201910253007.7, filed on Mar. 29, 2019, the entirety of which is incorporated herein by reference.

FIELD OF THE DISCLOSURE

The present disclosure a driving method for an electrowetting panel.

BACKGROUND

Microfluidics is often involved in systems that use microanalysis devices to process or control microfluids. It is an emerging interdisciplinary subject involving chemistry, fluid physics, microelectronics, new materials, and biomedical engineering. Electrowetting panel plays an extremely important role in the development of microfluidic technology. Due to its miniaturization, integration, and portability, the electrowetting panel integrates the functions of sampling, reaction, separation and detection of samples, and has great development potential and broad application prospects in the fields of chemical synthesis, biomedical, environmental monitoring, etc.

However, the electrowetting panel according to existing technology may have low driving efficiency for droplets, and may not be able to simultaneously move multiple droplets. The disclosed driving method for electrowetting panel is directed to solve one or more problems set forth above and other problems in the art.

BRIEF SUMMARY OF THE DISCLOSURE

One aspect of the present disclosure provides a driving method for an electrowetting panel. The driving method includes providing an electrowetting panel. The electrowetting panel includes a base substrate and M driving electrodes disposed on the base substrate. The M driving electrodes are sequentially arranged from a $1^{st}$ driving electrode to an $M^{th}$ driving electrode along a first direction. The driving method further includes providing electrical signals to the M driving electrodes, such that the $1^{st}$ driving electrode acquires a droplet from a solution reservoir, and the M driving electrodes drive the droplet to move. During a droplet moving period, a pulse width of a driving signal of an $m^{th}$ driving electrode is Wm with $$Wm = \sum_{i=1}^{m} W_i,$$

a pulse width of a non-driving signal between an $a^{th}$ driving signal and an $(a+1)^{th}$ driving signal of the $m^{th}$ driving electrode is Zma with $$Zma = \sum_{i=m+1}^{m+a} W_i,$$

an end time of a $1^{st}$ driving signal of the $m^{th}$ driving electrode and an end time of an $m^{th}$ driving signal of the $1^{st}$ driving electrode are same, and M, m, and a are positive integers, $1 \leq m \leq M$, and $M \geq 3$.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Various exemplary embodiments of the present disclosure will now be described in detail with reference to the accompanying drawings. It should be noted that the relative arrangement of the components and steps, numerical expressions and numerical values set forth in the embodiments are not intended to limit the scope of the present disclosure. The following description of the at least one exemplary embodiment is merely illustrative, and by no means can be considered as limitations for the application or use of the present disclosure.

It should be noted that techniques, methods, and apparatuses known to those of ordinary skill in the relevant art may not be discussed in detail, but where appropriate, the techniques, methods, and apparatuses should be considered as part of the specification.

In all of the examples shown and discussed herein, any specific values should be considered as illustrative only and not as a limitation. Therefore, other examples of exemplary embodiments may have different values.

It should be noted that similar reference numbers and letters indicate similar items in subsequent figures, and therefore, once an item is defined in a figure, it is not required to be further discussed or defined in the subsequent figures.

Figure 1:
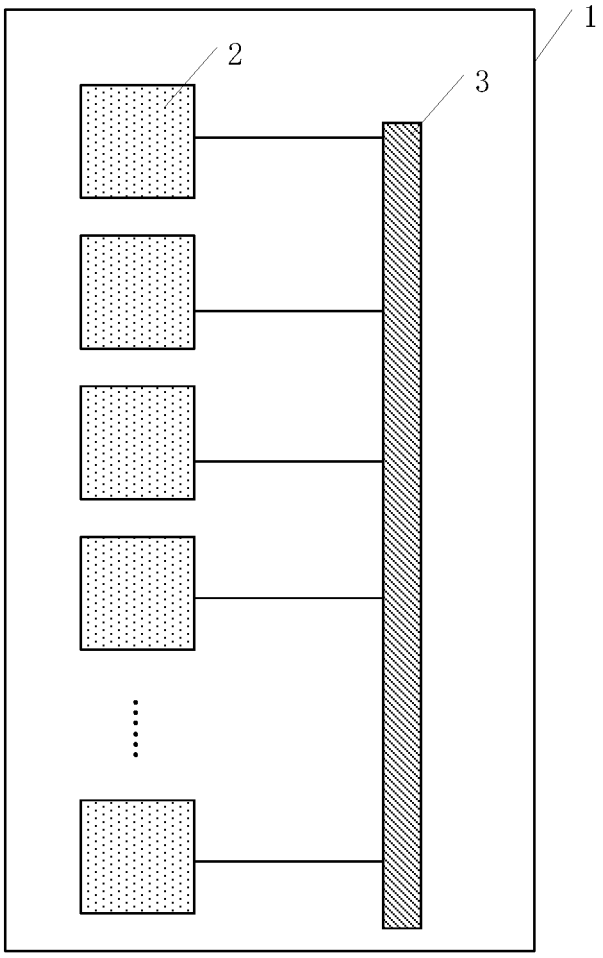
FIG. 1 illustrates a schematic structural view of an electrowetting panel.

FIG. 1 illustrates a schematic structural view of an electrowetting panel. Referring to FIG. 1, the electrowetting panel includes a base substrate 1, a plurality of electrodes 2 disposed on the base substrate 1, and a driving circuit 3. The driving circuit 3 is electrically connected to the plurality of electrodes 2, and is configured to provide electrical signals to the plurality of electrodes 2 to drive droplets to move in the electrowetting panel. However, the electrowetting panel according to the existing technology may have low driving efficiency, and may be unable to simultaneously move multiple droplets.

Figure 2:
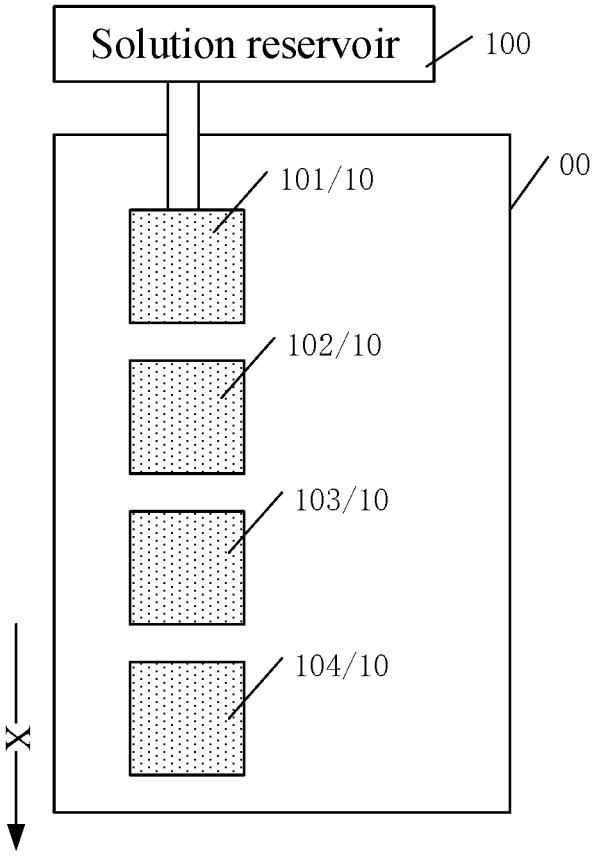
FIG. 2 illustrates a schematic plan view of an electrowetting panel according to some embodiments of the present disclosure.

The present disclosure provides a driving method for an electrowetting panel. FIG. 2 illustrates a schematic plan view of an electrowetting panel according to some embodiments of the present disclosure, and FIG. 3 illustrates a driving sequence diagram of driving voltages of an exemplary driving method for an electrowetting panel according to some embodiments of the present disclosure.

Figure 3:
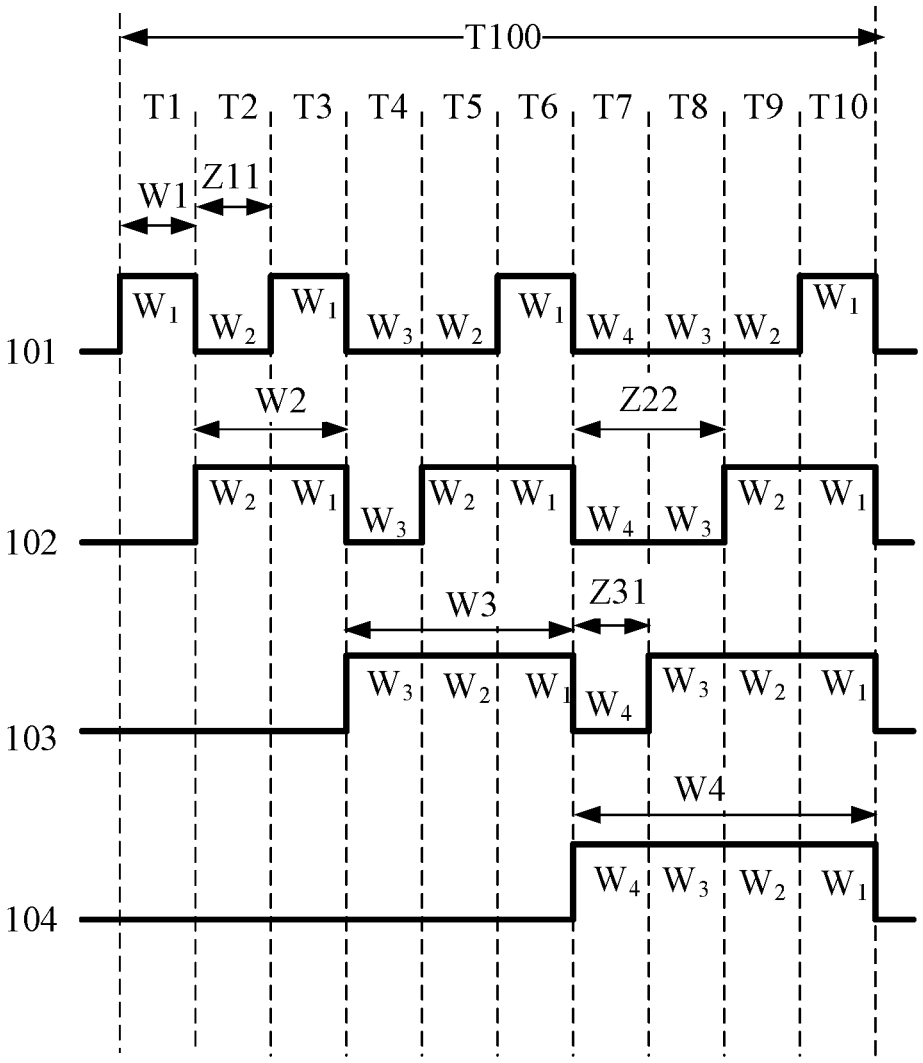
FIG. 3 illustrates a driving sequence diagram of driving voltages of an exemplary driving method for an electrowetting panel according to some embodiments of the present disclosure.

Referring to FIGS. 2-3, the electrowetting panel may include a base substrate 00 and M driving electrodes 10 disposed on a side of the base substrate 00. That is, the number of the driving electrodes 10 disposed on the base substrate 00 may be M, where M is a positive integer greater than or equal to 3 (e.g., M≥3). The M driving electrodes 10 may be arranged along a first direction X. For example, along the first direction X, the M driving electrodes 10 may sequentially include a $1^{st}$ driving electrode 10, a $2^{nd}$ driving electrode 10, . . . , an $M^{th}$ driving electrode 10.

The driving method may include, during a droplet moving period T100, providing electrical signals to the M driving electrodes 10, such that the $1^{st}$ driving electrode 10 acquires a droplet from a solution reservoir 100, and the M driving electrodes 10 drive the droplet to move.

For example, a pulse width of the driving signal for an $m^{th}$ driving electrode 10 may be Wm with $$Wm = \sum_{i=1}^{m} W_i,$$

where 1≤m≤M; a pulse width of a non-driving signal between an $a^{th}$ driving signal and an $(a+1)^{th}$ driving signal of the $m^{th}$ driving electrode 10 may be Zma with $$Zma = \sum_{i=m+1}^{m+a} W_i,$$

where a is an integer. The end time of the $1^{st}$ driving signal of the $m^{th}$ driving electrode 10 and the end time of the $m^{th}$ driving signal of the $1^{st}$ driving electrode 10 may be the same.

In one embodiment, the base substrate 00 may be used to carry structures including the driving electrodes 10, a plurality of signal terminals (not shown), etc. The base substrate 00 may be a hard substrate made of glass or any other appropriate material.

In one embodiment, a total number M of driving electrodes 10 may be disposed on the base substrate 00. The electrowetting panel is described to, as an example, include M=4 driving electrodes 10 for illustration. In other embodiments, the integer M may take a minimum value of 3, or may be larger than 4. In one embodiment, a plurality of electrodes in other types may also be disposed on the base substrate 00. In one embodiment, each driving electrode 10 may have a rectangular shape. In other embodiments, the shapes of the driving electrodes may have various shapes, including but not limited to rectangular shapes.

The M driving electrodes 10 may be arranged along the first direction X. When the electrowetting panel according to the present disclosure drives droplets to move, the moving direction of the droplets may be the first direction X.

In order to illustrate the technical scheme of the disclosed driving method for the electrowetting panel, the driving electrodes 10 and the signal terminals are labeled in numbers. For example, the four driving electrodes 10 shown in FIG. 2 are denoted as a $1^{st}$ driving electrode 101, a $2^{nd}$ driving electrode 102, a $3^{rd}$ driving electrode 103, and a $4^{th}$ driving electrode 104, respectively in the first direction X (e.g. the direction away from the solution reservoir 100).

The driving sequence diagram of each driving electrode according to the driving method for the electrowetting panel is shown in FIG. 3. In one embodiment, corresponding to a same driving electrode, the driving signals may have a same pulse width.

For example, the pulse width of the driving signals for the $1^{st}$ driving electrode 101 may be W1 with $Wm=W_1$; the pulse width of the driving signals for the $2^{nd}$ driving electrode 102 may be W2 with $$W2 = \sum_{i=1}^{2} W_i = W_1 + W_2;$$

the pulse width of the driving signals for the $3^{rd}$ driving electrode 103 may be W3 with $$W3 = \sum_{i=1}^{3} W_i = W_1 + W_2 + W_3;$$

and the pulse width of the driving signals for the $4^{th}$ driving electrode 104 may be W4 with $$W4 = \sum_{i=1}^{4} W_i = W_1 + W_2 + W_3 + W_4.$$

For any given driving electrode, a non-driving signal may separate two adjacent driving signals. That is, a non-driving signal may be present between every two adjacent driving signals. In one embodiment, corresponding to a same driving electrode, the pulse width may be different for different non-driving signals between adjacent driving signals.

In one embodiment, for example, when m=1 and a=1, the pulse width of the non-driving signal between the $1^{st}$ driving signal and the $2^{nd}$ driving signal of the $1^{st}$ driving electrode 10 may be Z11 with $$Z11 = \sum_{i=2}^{2} W_i = W_2.$$

In another example, when m=2 and a=2, the pulse width of the non-driving signal between the $2^{nd}$ driving signal and the $3^{rd}$ driving signal of the $2^{nd}$ driving electrode 10 may be Z22 with $$Z22 = \sum_{i=3}^{4} W_i = W_3 + W_4.$$

In another example, when m=3 and a=1, the pulse width of the non-driving signal between the $1^{st}$ driving signal and the $2^{nd}$ driving signal of the $3^{rd}$ driving electrode 10 may be Z31 with $$Z31 = \sum_{i=4}^{4} W_i = W_4.$$

In one embodiment, the end time of the $1^{st}$ driving signal of the $m^{th}$ driving electrode 10 may be the same as the end time of the $m^{th}$ driving signal of the $1^{st}$ driving electrode 10 to ensure that the driving electrodes 10 are able to cooperate with each other to drive the droplets to move smoothly along the first direction X.

Figure 4:
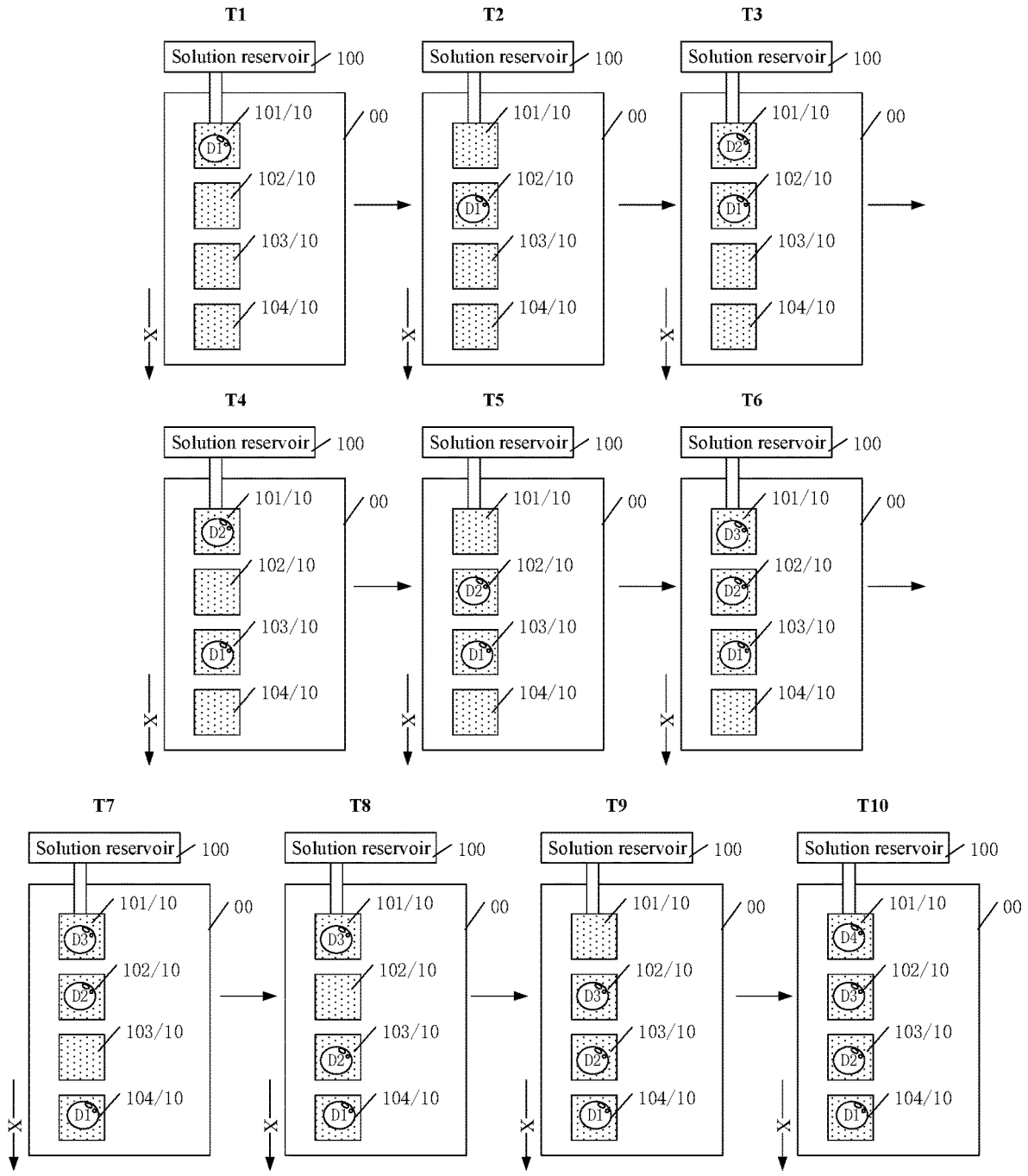
FIG. 4 illustrates a schematic diagram of operating states of an electrowetting panel corresponding to different moments in FIG. 3.

FIG. 4 illustrates a schematic diagram of operating states of an electrowetting panel corresponding to different moments in FIG. 3. Referring to FIGS. 3-4, the driving signals of the $1^{st}$ driving electrode 101 may all be used to acquire droplets from the solution reservoir 100. Accordingly, as indicated by the driving sequence diagram shown in FIG. 3, driving signals with high electric potentials are provided to the $1^{st}$ driving electrode 101 for 4 times, and the $1^{st}$ driving electrode 101 may thus acquire droplets 4 times from the solution reservoir 100. The droplets acquired sequentially from the 4 times of acquisition may be denoted as D1, D2, D3, and D4. It should be noted that, at the initial stage, e.g. during a time period T1, a low electrical-potential signal may be provided to the solution reservoir 100 through a first driving circuit (not shown), and a high electrical-potential signal may be provided to the $1^{st}$ driving electrode 101 through a second driving circuit (not shown), such that a droplet may move from the solution reservoir 100 to the $1^{st}$ driving electrode 101, e.g., a droplet may be acquired by the $1^{st}$ driving electrode 101 from the solution reservoir 100. Further, in subsequent processes, the solution reservoir 100 may remain at the low electric-potential state and the droplet may be driven to move by providing different driving electrodes with different signals. For example, the process of acquiring a droplet and driving the droplet to move may include the following exemplary steps.

During a time period T1, the $1^{st}$ driving electrode 101 may acquire a droplet D1 from the solution reservoir 100.

During a time period T2, the droplet D1 may move to the $2^{nd}$ driving electrode 102.

During a time period T3, the $1^{st}$ driving electrode 101 may acquire a droplet D2 from the solution reservoir 100. At this time, the droplet D1 may be held at the $2^{nd}$ driving electrode 102 instead of moving toward the $3^{rd}$ driving electrode 103 due to the following reason. When the $1^{st}$ driving electrode 101 acquires the droplet D2 from the solution reservoir 100 and drives the droplet D1 to move toward the $3^{rd}$ driving electrode 103 simultaneously, the $1^{st}$ driving electrode 101 and the $3^{rd}$ driving electrode 103 may both have high electric-potential signals, and the $2^{nd}$ driving electrode 102 may have a low electric-potential signal. As such, the droplet D1 may not be able to move at the moment, and instead, the droplet D1 may stay at the $2^{nd}$ driving electrode 102. Therefore, in one embodiment, at a given moment, the M driving electrodes arranged along the first direction X may only drive one droplet to move.

During a time period T4, the droplet D1 may move to the $3^{rd}$ driving electrode 103.

During a time period T5, the droplet D2 may move to the $2^{nd}$ driving electrode 103.

During a time period T6, the $1^{st}$ driving electrode 101 may acquire a droplet D3 from the solution reservoir 100.

During a time period T7, the droplet D1 may move to the $4^{th}$ driving electrode 104.

During a time period T8, the droplet D2 may move to the $3^{rd}$ driving electrode 103.

During a time period T9, the droplet D3 may move to the $2^{nd}$ driving electrode 102.

During a time period T10, the $1^{st}$ driving electrode 101 may acquire a droplet D4 from the solution reservoir 100.

At this time, the four driving electrodes, e.g. the driving electrodes from the $1^{st}$ driving electrode 101 to the $4^{th}$ driving electrode 104, may all be covered with droplets.

It should be noted that, for illustrative purposes, in various embodiments of the present disclosure, the driving signal is described to be a high electric-potential signal and the non-driving signal is described to be a low electric-potential signal. In some other embodiments of the present disclosure, the driving signal may be a low electric-potential signal, and the non-driving signal may be a high electric-potential signal. In practical applications, whether the driving signal is a high electric-potential signal may be determined according to actual needs.

According to the present disclosure, the driving method may be able to sequentially acquire droplets multiple times from the solution reservoir, and may efficiently drive the droplets acquired multiple times to make the droplets spread over the driving electrodes. Compared with existing driving methods, the disclosed driving method may be able to simultaneously drive the droplets that are acquired in multiple times, and thus improve the driving efficiency. In addition, using the driving method according to various embodiments of the present disclosure, the droplets can cover the first m driving electrodes, where m is an integer satisfying $1 \leq m \leq M$. The value of m may be determined according to actual needs, and it may not be necessary to separately set electrical signals for the driving electrodes. Therefore, the driving method may be flexible.

Figure 5:
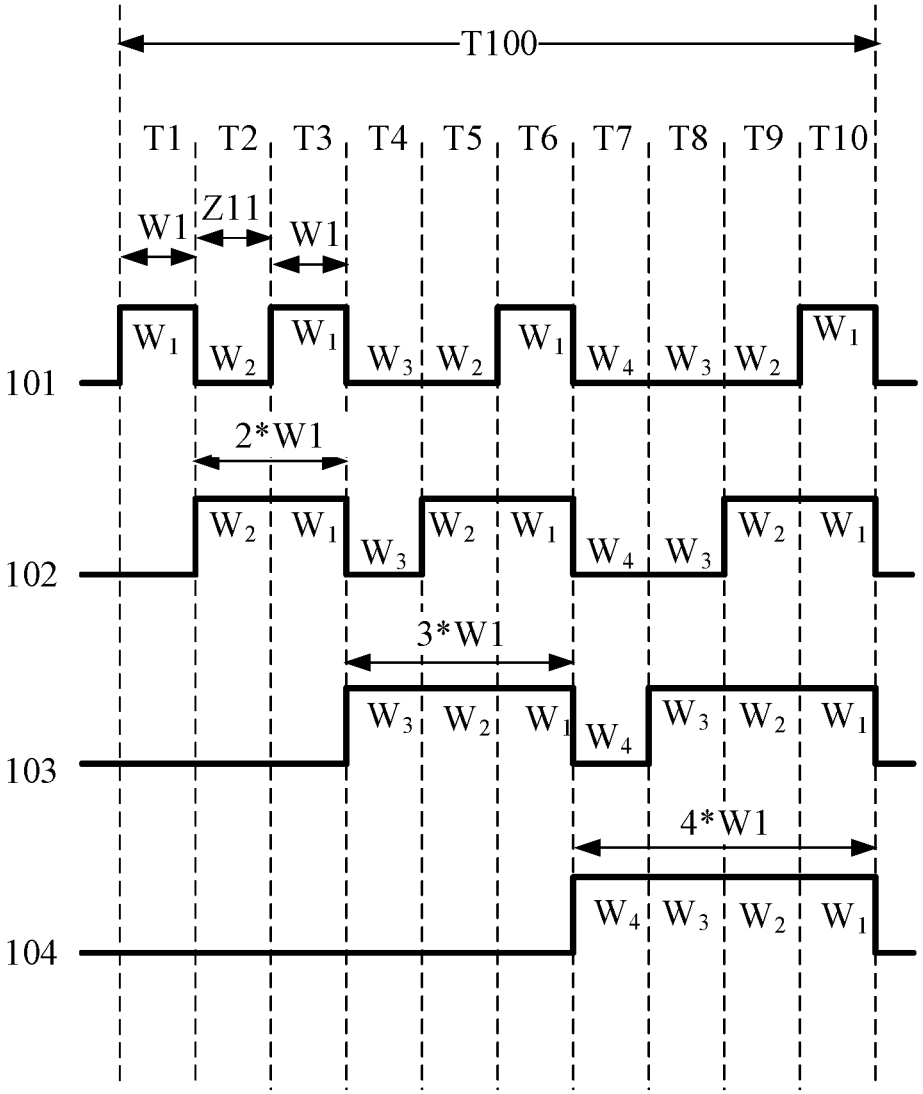
FIG. 5 illustrates a driving sequence diagram of driving voltages of another exemplary driving method for an electrowetting panel according to some embodiments of the present disclosure.

FIG. 5 illustrates a driving sequence diagram of driving voltages of another exemplary driving method for an electrowetting panel according to some embodiments of the present disclosure. Referring to FIG. 5, in some embodiments, the pulse width of a driving signal of the $1^{st}$ driving electrode 101 may be W1, and the pulse width of a non-driving signal between the $1^{st}$ driving signal and the $2^{nd}$ driving signal of the $1^{st}$ driving electrode 10 may be Z11, where W1=Z11.

In addition, the pulse width of a driving signal of an $m^{th}$ driving electrode 10 may be (m×W1), and the pulse width of a non-driving signal between an $a^{th}$ driving signal and an $(a+1)^{th}$ driving signal of an $m^{th}$ driving electrode 10 may be (a×Z11).

For example, according to the disclosed driving method, the pulse width of the driving signal of the $2^{nd}$ driving electrode 102 may be (2×W1), the pulse width of the driving signal of the $3^{rd}$ driving electrode 103 may be (3×W1), and the pulse width of the driving signal of the $4^{th}$ driving electrode 104 may be (4×W1).

In addition, for any driving electrode of the plurality of driving electrodes, the pulse width of the non-driving signal between two adjacent driving signals may be a positive integer multiple of W1.

According to the disclosed driving method, the design of the electrical signal can be further simplified, and the difficulty of the driving method can be reduced.

Figure 6:
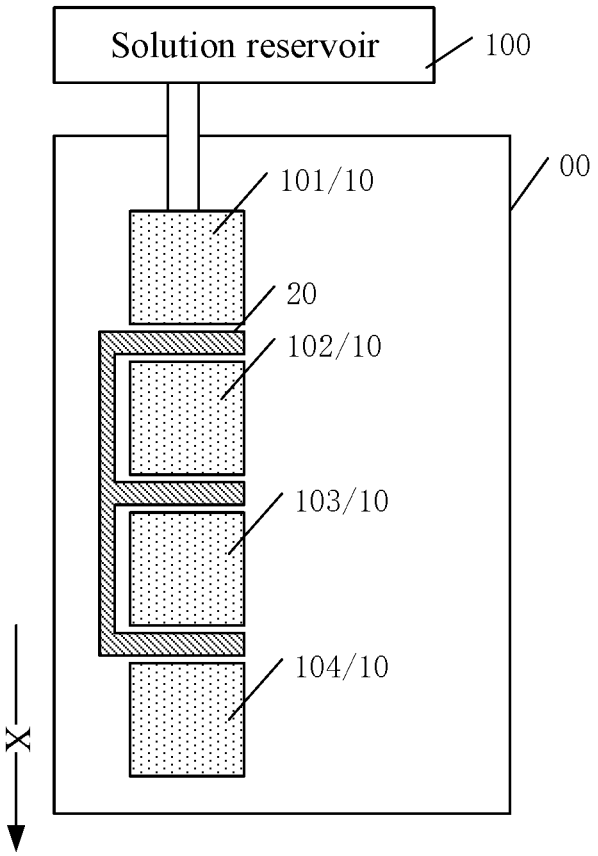
FIG. 6 illustrates a schematic plan view of another electrowetting panel according to some embodiments of the present disclosure.
Figure 7:
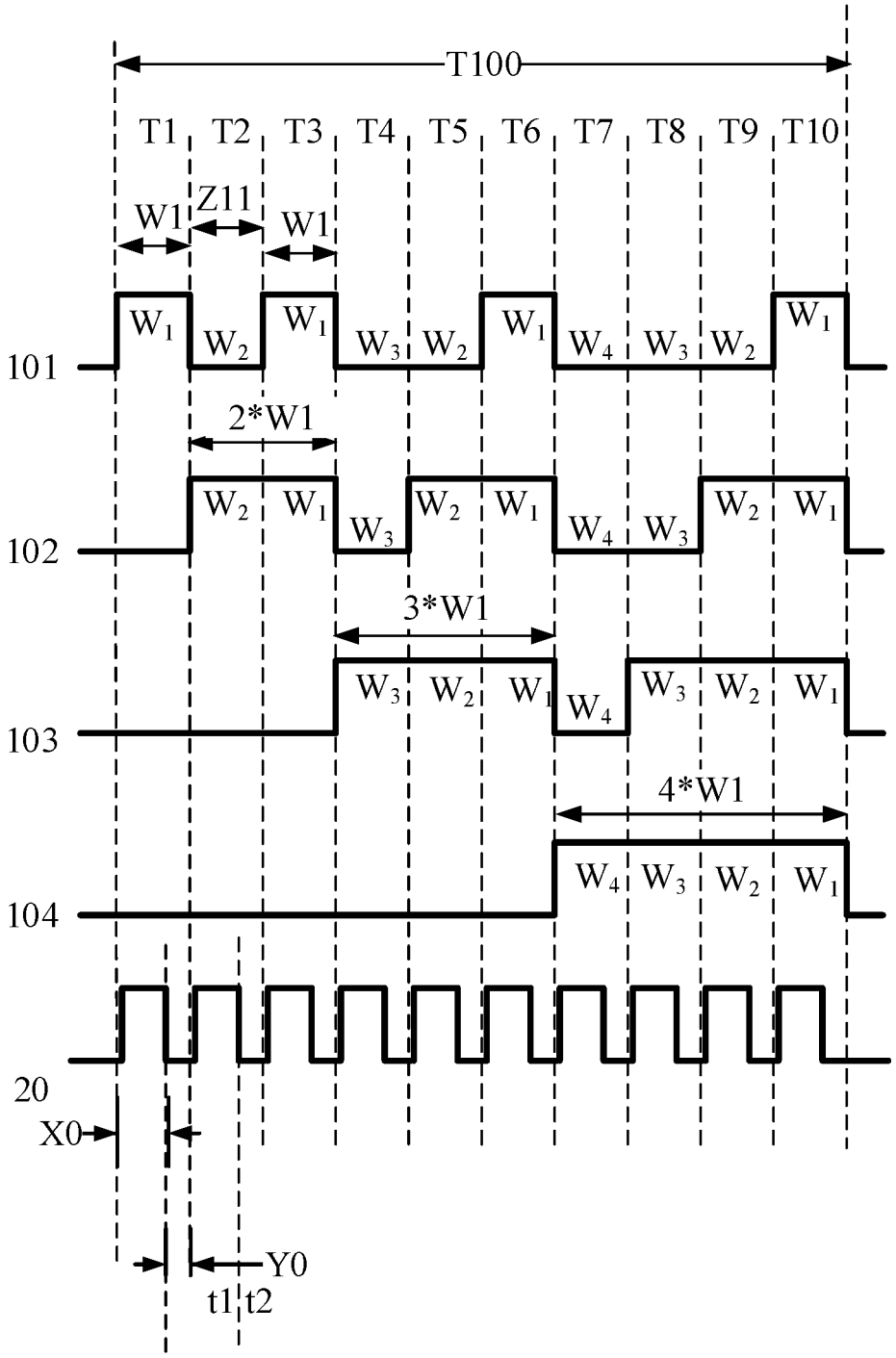
FIG. 7 illustrates a driving sequence diagram of driving voltages of another exemplary driving method for an electrowetting panel according to some embodiments of the present disclosure.

FIG. 6 illustrates a schematic plan view of another electrowetting panel according to some embodiments of the present disclosure, and FIG. 7 illustrates a driving sequence diagram of driving voltages of another exemplary driving method for an electrowetting panel according to some embodiments of the present disclosure.

Referring to FIGS. 6-7, the electrowetting panel may further include one or more auxiliary electrodes 20 located between adjacent driving electrodes 10. Accordingly, the driving method may include: providing an electrical signal to the one or more auxiliary electrodes 20 to assist droplets to move.

The pulse width of the driving signal of the auxiliary electrode 20 may be X0, and the pulse width of the non-driving signal between two adjacent driving signals of the auxiliary electrode 20 may be Y0, where X0+Y0=W1.

According to the disclosed driving method, one or more auxiliary electrodes 20 may be disposed in the electrowetting panel, and the one or more auxiliary electrodes 20 may be used to assist the driving electrodes to operate, such that the control of the droplet movement may be more precisely.

Further, the operating principle of each auxiliary electrode 20 during the time period T2 is described below.

The time period T2 may include a time period t1 and a time period t2, and the time period of the driving signal of the auxiliary electrode 20 may be the time period t1, while the time period of the non-driving signal of the auxiliary electrode 20 may be the time period t2.

During the time period T2, the droplet D1 may move to the $2^{nd}$ driving electrode 102.

During the first portion of the time period T2, e.g., the time period t1, the auxiliary electrode 20 may be closer to the $1^{st}$ driving electrode 101, and the driving signal of the auxiliary electrode 20 may drive the droplet D1 to move toward the auxiliary electrode 20.

During the second portion of the time period T2, e.g., the time period t2, when the droplet D1 moves to the auxiliary electrode 20, the auxiliary electrode 20 may have a non-driving signal, and the driving signal of the $2^{nd}$ driving electrode 102 may drive the droplet D1 to move toward the $2^{nd}$ driving electrode 102, such that the droplet D1 may eventually moves to the $2^{nd}$ driving electrode 102.

According to the disclosed driving method, the auxiliary electrode 20 may be able to assist the driving electrodes 10 to operate and to move the droplet to a predetermined position. Especially, when the distance between two adjacent driving electrodes is large, the disclosed driving method may be able to more precisely control the droplet to move.

It should be noted, the number of the auxiliary electrodes 20 may be one or more than one. Each auxiliary electrode 20 may assist the operation of the driving electrode 10 adjacent to the auxiliary electrode 20.

In some embodiments, between every two adjacent driving electrodes 10, an auxiliary electrode 20 may be disposed. In addition, the one or more auxiliary electrodes 20 may be electrically connected to each other, and thus the electrical signals of different auxiliary electrodes 20 may also be the same. By disposing an auxiliary electrode 20 between every two adjacent driving electrodes 10, the driving method may be able to control the movement of the droplets more precisely.

Figure 8:
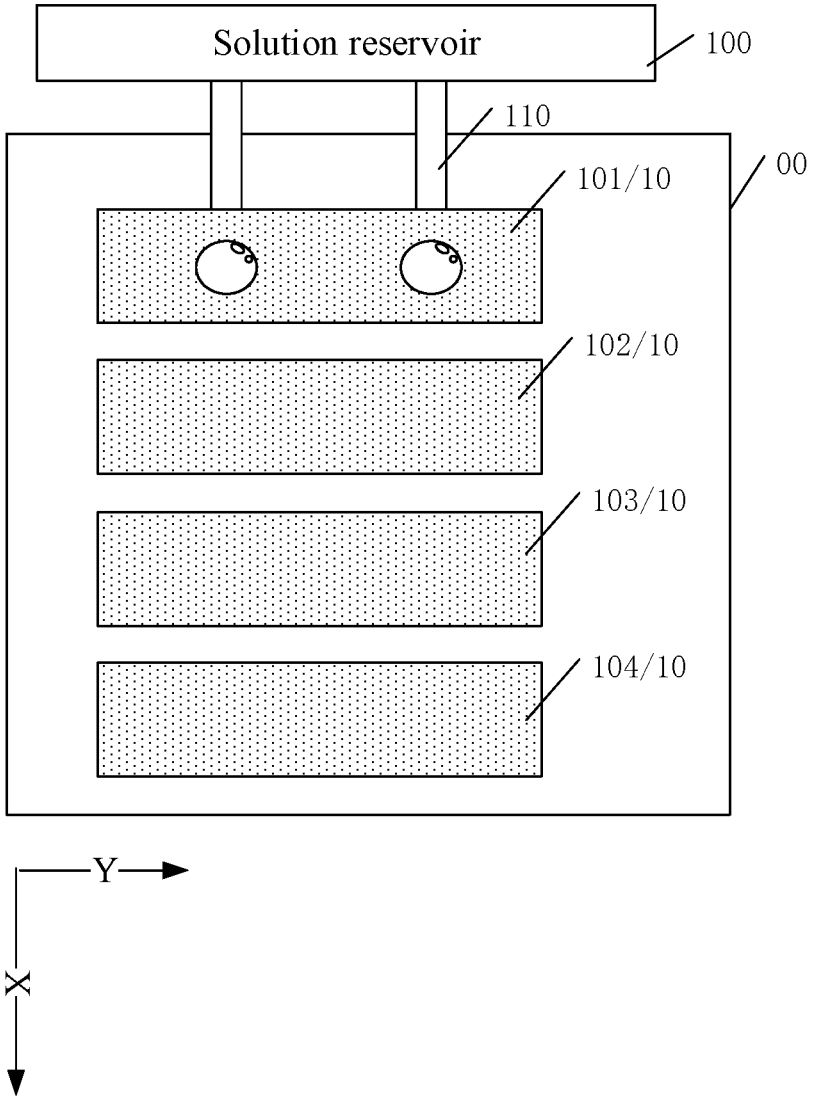
FIG. 8 illustrates a schematic plan view of another electrowetting panel according to some embodiments of the present disclosure.

FIG. 8 illustrates a schematic plan view of another electrowetting panel according to some embodiments of the present disclosure. Referring to FIG. 8, in one embodiment, each driving electrode 10 may have a long strip shape extending along a second direction Y, and the second direction Y may intersect the first direction X.

T channels 110 may be disposed between the $1^{st}$ driving electrode 101 and the solution reservoir 100, where T is an integer greater than or equal to 2. Therefore, the $1^{st}$ driving electrode 10 (101) and the solution reservoir 100 may be connected through T channels 110.

The driving method for the electrowetting panel may include acquiring T droplets each time through the $1^{st}$ driving electrode 10.

According to the disclosed driving method for the electrowetting panel, the driving electrode 10 is disposed in a long strip shape extending along a second direction Y to acquire more than two droplets at a same time. In one embodiment, the second direction Y and the first direction X may be perpendicular to each other.

By disposing T channels 110 between the $1^{st}$ driving electrode 10 and the solution reservoir 100, the $1^{st}$ driving electrode 10 may be able to acquire a droplet through every channel 110 for each time. It should be understood that the T channels 110 may be distributed along the second region Y. Because the driving electrode 10 is disposed in a long strip shape extending along the second direction Y, the T channels 110 may be arranged to be more dispersed (for example, the distance between every two channels 110 may be sufficiently large) to prevent the droplets from contacting each other, and thus the accuracy of droplet control may be further improved.

Figure 9:
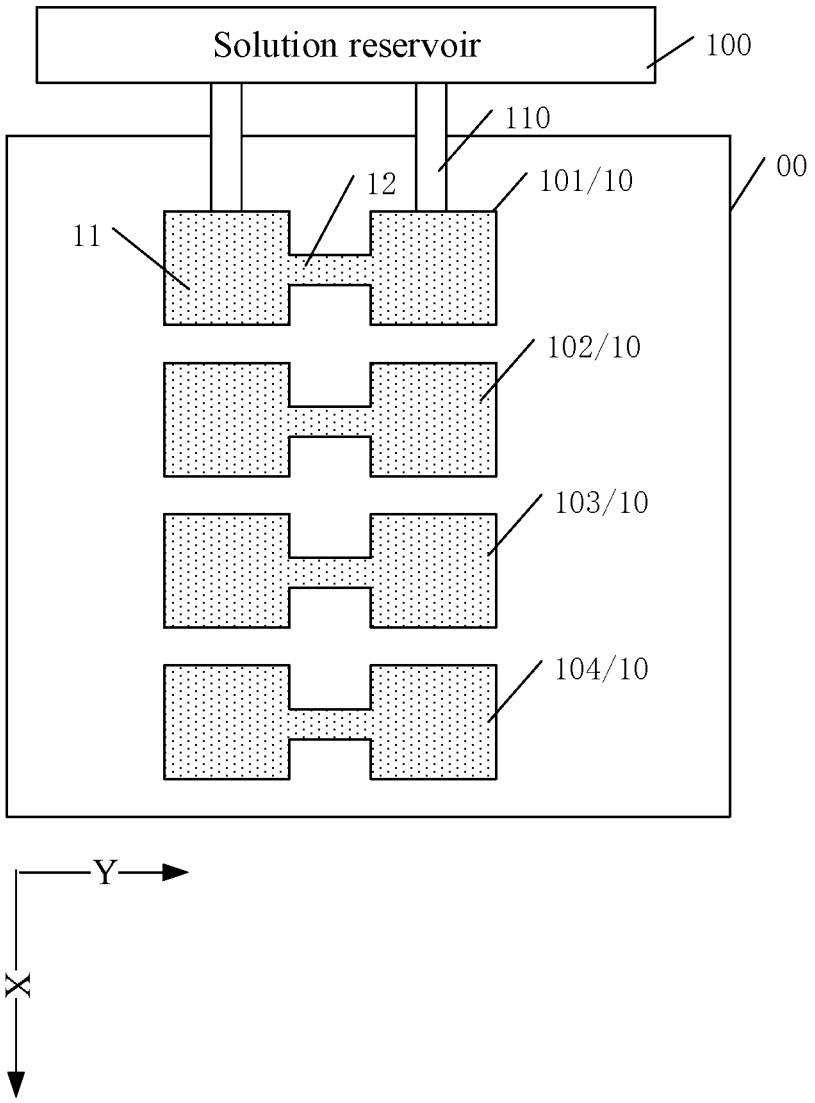
FIG. 9 illustrates a schematic plan view of another electrowetting panel according to some embodiments of the present disclosure.

FIG. 9 illustrates a schematic plan view of another electrowetting panel according to some embodiments of the present disclosure. Referring to FIG. 9, in one embodiment, each driving electrode 10 may include T sub-electrodes 11 with a connection bridge 12 disposed between adjacent sub-electrodes 11. Along the second direction Y, the width of the sub-electrode 11 may be larger than the width of the connection bridge 12.

For example, in the electrowetting panel, each driving electrode 10 may include at least two sub-electrodes 11, and at least two sub-electrodes 11 may be electrically connected together through one or more connection bridges 12 with each disposed between two adjacent sub-electrodes 11. In some embodiments, the at least two sub-electrodes 11 and the one or more connection bridges 12 may have an integral structure. Therefore, the sub-electrodes 11 and the connection bridges 12 may be formed in a same fabrication process.

The at least two sub-electrodes 11 of each driving electrode 10 may form at least two columns along the first direction X. The sub-electrodes 11 in a same column may be used to drive droplets to move along the first direction X. Accordingly, the number of the channels 110 may be the same as the number of the columns formed by the sub-electrodes 11.

In order to further improve the accuracy of the droplet movement, in one embodiment, the width of the sub-electrode 11 in the second direction Y may be larger than the width of the connection bridge 12 in the second direction Y. Because the connection bridge 12 is narrower, the distance between adjacent connection bridges 12 in the second direction Y may be increased, such that the electrical field between the two may be reduced to prevent the droplet from moving toward the connection bridge 12 and deviating from the preset movement trajectory during the moving process.

Figure 10:
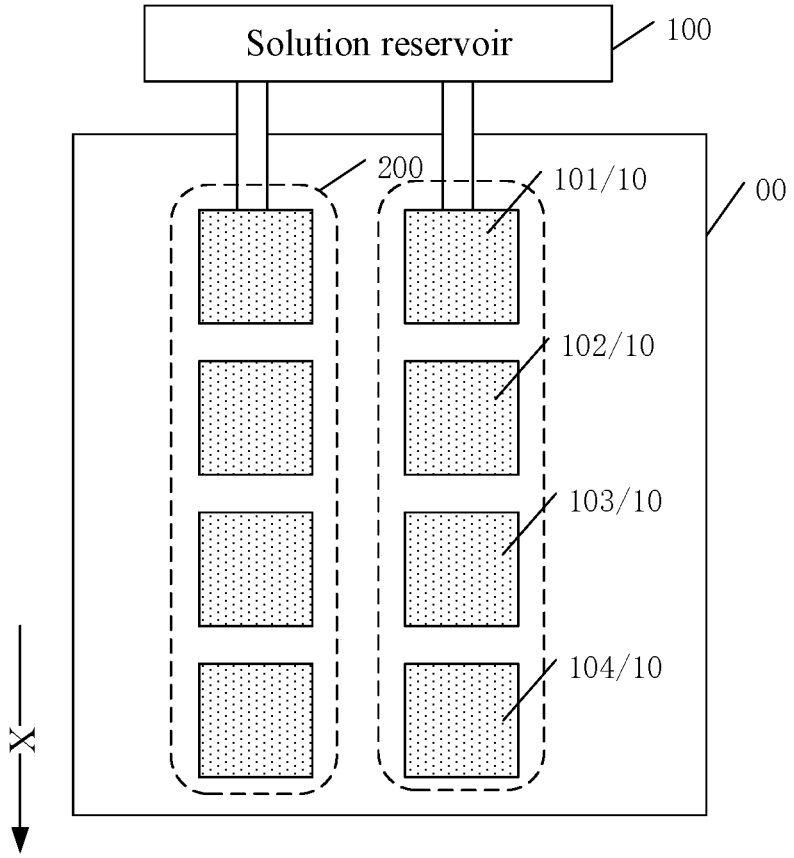
FIG. 10 illustrates a schematic plan view of another electrowetting panel according to some embodiments of the present disclosure.

FIG. 10 illustrates a schematic plan view of another electrowetting panel according to some embodiments of the present disclosure. Referring to FIG. 10, in one embodiment, the electrowetting panel may include at least two electrode groups 200. Each electrode group 200 may include M driving electrodes 10 arranged on a side of the base substrate 00 along the first direction X.

For example, at least two electrode groups 200 may be disposed in the electrowetting panel. Each electrode group 200 may include M driving electrodes 10 disposed on a side of the base substrate 00 along the first direction X.

Each electrode group 200 may be able to drive droplets according to the driving method described above. Therefore, the driving method according to the present disclosure can simultaneously control the operation of at least two electrode groups 200, and thus may further improve the efficiency of droplet movement.

Figure 11:
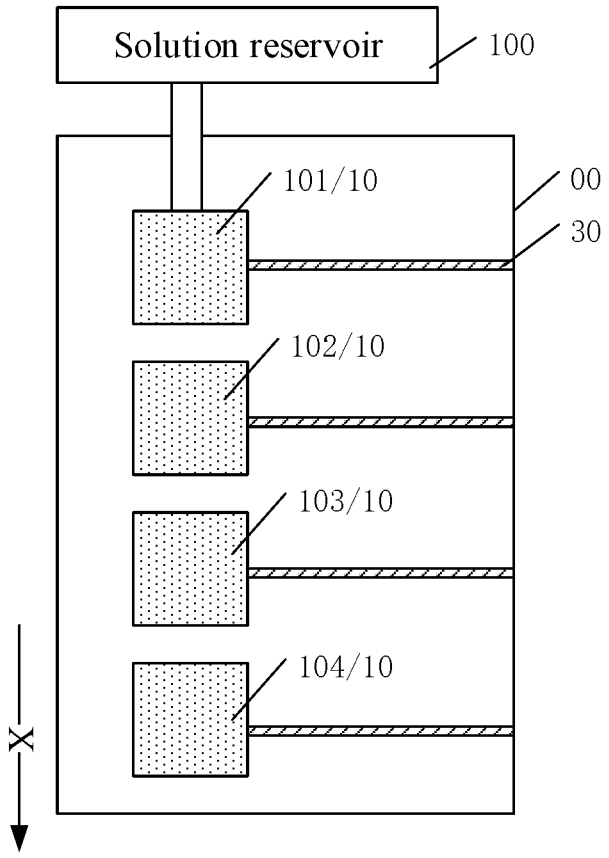
FIG. 11 illustrates a schematic plan view of another electrowetting panel according to some embodiments of the present disclosure.

FIG. 11 illustrates a schematic plan view of another electrowetting panel according to some embodiments of the present disclosure. Referring to FIG. 11, in one embodiment, the electrowetting panel may also include M signal lines 30. Each signal line 30 may be electrically connected to a corresponding driving electrode 10.

In one embodiment, the electrowetting panel may further include M signal lines 30, and each signal line 30 of the M signal lines 30 may be electrically connected to a driving electrode 10. That is, the M signal lines 30 and the M driving electrodes 10 may be in one-to-one correspondence. An electrical signal can be transmitted to each driving electrode 10 through the corresponding signal line 30, and thus the electrical signal of each driving electrode 10 can be individually controlled. Therefore, the driving method may be simple and efficient.

Figure 12:
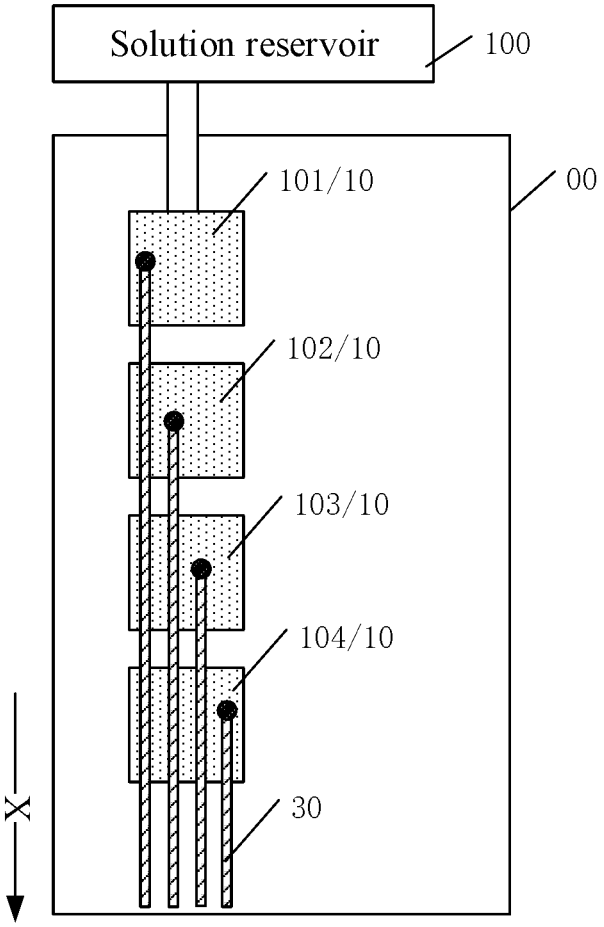
FIG. 12 illustrates a schematic plan view of another electrowetting panel according to some embodiments of the present disclosure.

FIG. 12 illustrates a schematic plan view of another electrowetting panel according to some embodiments of the present disclosure. Referring to FIG. 12, in one embodiment, the signal lines 30 and the driving electrodes 10 may be located in different conductive layers. The signal lines 30 and the driving electrodes 10 may partially overlap with each other in a direction perpendicular to the plane in which the driving electrodes 10 are located. That is, in a direction perpendicular to the plane of the driving electrodes 10, the projection of the signal lines 30 may partially overlap with the projection of the driving electrodes 10 on the plane of the driving electrodes 10. It should be noted that FIG. 12 schematically illustrates the electrowetting panel viewed in the direction perpendicular to the plane of the driving electrodes 10.

In the electrowetting panel, the signal lines 30 and the driving electrodes 10 may be disposed in different conductive layers. An insulating layer may be disposed between the signal lines 30 and the driving electrodes 10 to electrically isolate the two. Therefore, the signal lines 30 may be partially arranged to overlap the driving electrodes 10 in the direction perpendicular to the plane of the driving electrodes 10. As such, the space occupied by the signal lines 30 on the base substrate 00 can be reduced, making the arrangement of the structures in the electrowetting panel more compact, and thus facilitating the miniaturization of the electrowetting panel.

Figure 13:
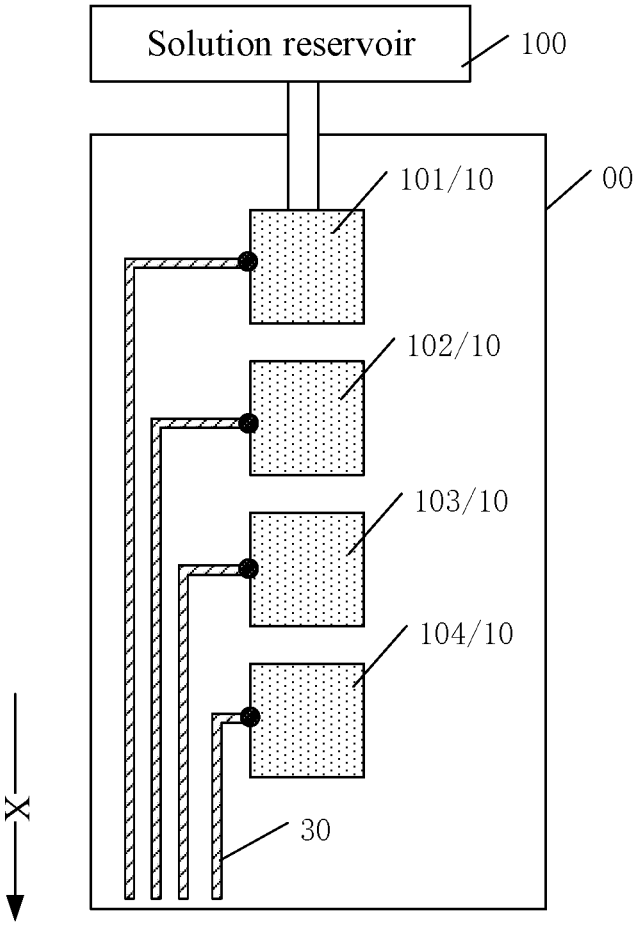
FIG. 13 illustrates a schematic plan view of another electrowetting panel according to some embodiments of the present disclosure.

FIG. 13 illustrates a schematic plan view of another electrowetting panel according to some embodiments of the present disclosure. Referring to FIG. 13, in one embodiment, the signal lines 30 and the driving electrodes 10 may not overlap with each other in a direction perpendicular to the plane in which the driving electrodes 10 are located. That is, the in a direction perpendicular to the plane of the driving electrodes 10, the projection of the signal lines 30 and the projection of the driving electrodes 10 are not overlapped with each other on the plane of the driving electrodes 10. It should be noted that FIG. 13 shows the electrowetting panel viewed in the direction perpendicular to the plane of the driving electrodes 10.

In the electrowetting panel, the signal lines 30 and the driving electrodes 10 may be disposed to not overlap with each other, such that the coupling capacitance between the driving electrodes 10 and the signal lines 30 can be reduced. As such, the influence of the electrical signal of the signal lines 30 on the driving electrodes 10 that are electrically isolated from the signal lines 30 can be reduced. Therefore, the accuracy of the electrical signal of each driving electrode 10 may be further improved, and thus the accuracy for driving droplets may be improved.

In one embodiment, because the signal lines 30 are disposed to not overlap with the driving electrodes 10, the signal lines 30 and the driving electrodes may be disposed in a same conductive layer, which may be beneficial to reducing the number of film-layer structures in the electrowetting panel, and may facilitate the thinning of the electrowetting panel.

In one embodiment, the signal lines 30 and the driving electrodes 10 may have an integral structure, and may be formed in a same fabrication process, which may be conducive to reducing the number of the process steps of the electrowetting panel, and reducing the cost.

Figure 14:
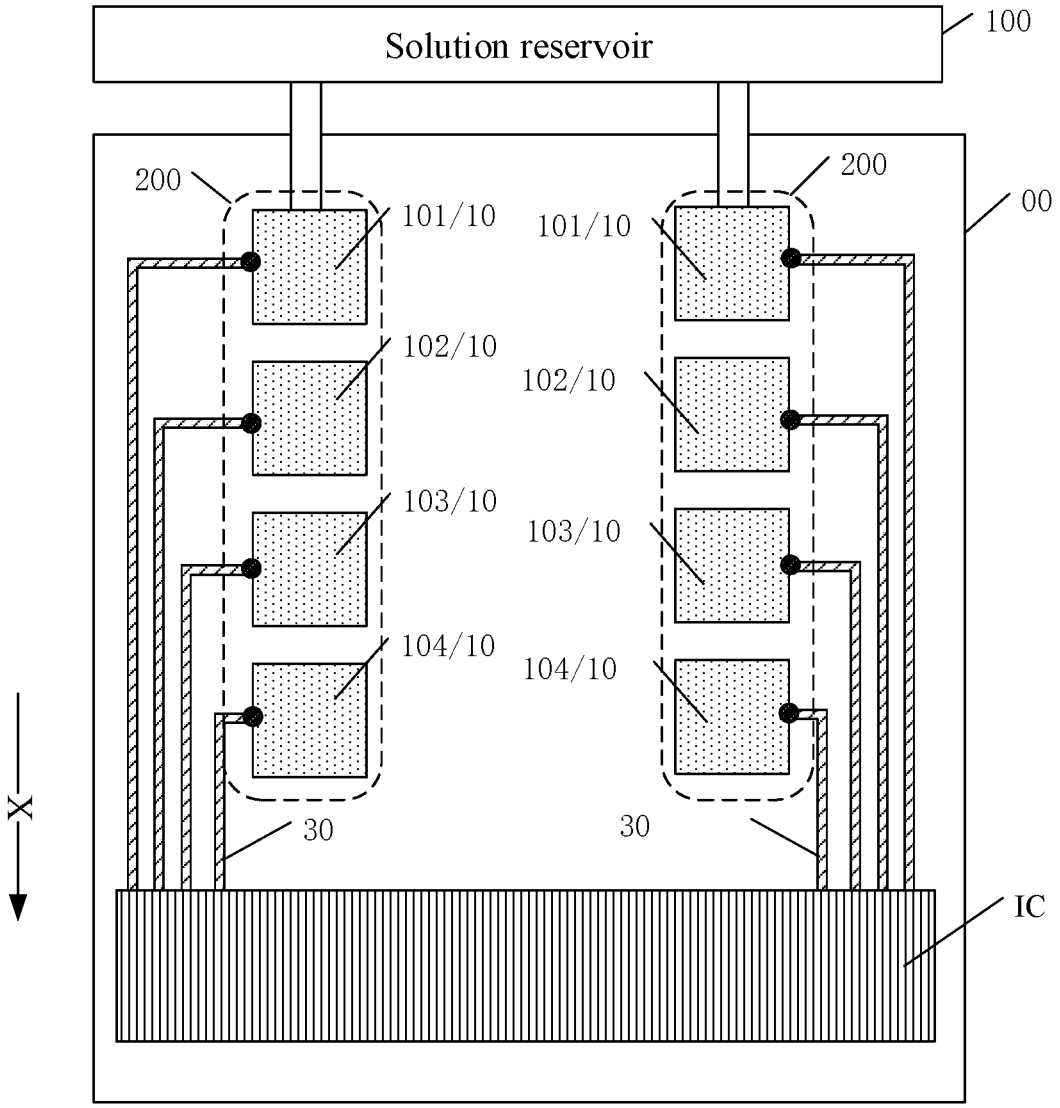
FIG. 14 illustrates a schematic plan view of another electrowetting panel according to some embodiments of the present disclosure.

FIG. 14 illustrates a schematic plan view of another electrowetting panel according to some embodiments of the present disclosure. Referring to FIG. 14, in one embodiment, the electrowetting panel may include at least two electrode groups 200. For illustrative purposes, only two electrode groups 200 are shown in FIG. 14 as examples for illustrating the electrowetting panel. Each electrode group 200 may include M driving electrodes 10 arranged on a side of the base substrate 00 along the first direction X, and corresponding to each electrode group 200, M signal lines 30 may be disposed in the electrowetting panel. Moreover, the electrowetting panel may also include a chip IC, and the chip IC may be electrically connected to the signal lines 30. Electrical signals may be transmitted to the driving electrodes through the signal lines 30.

Figure 15:
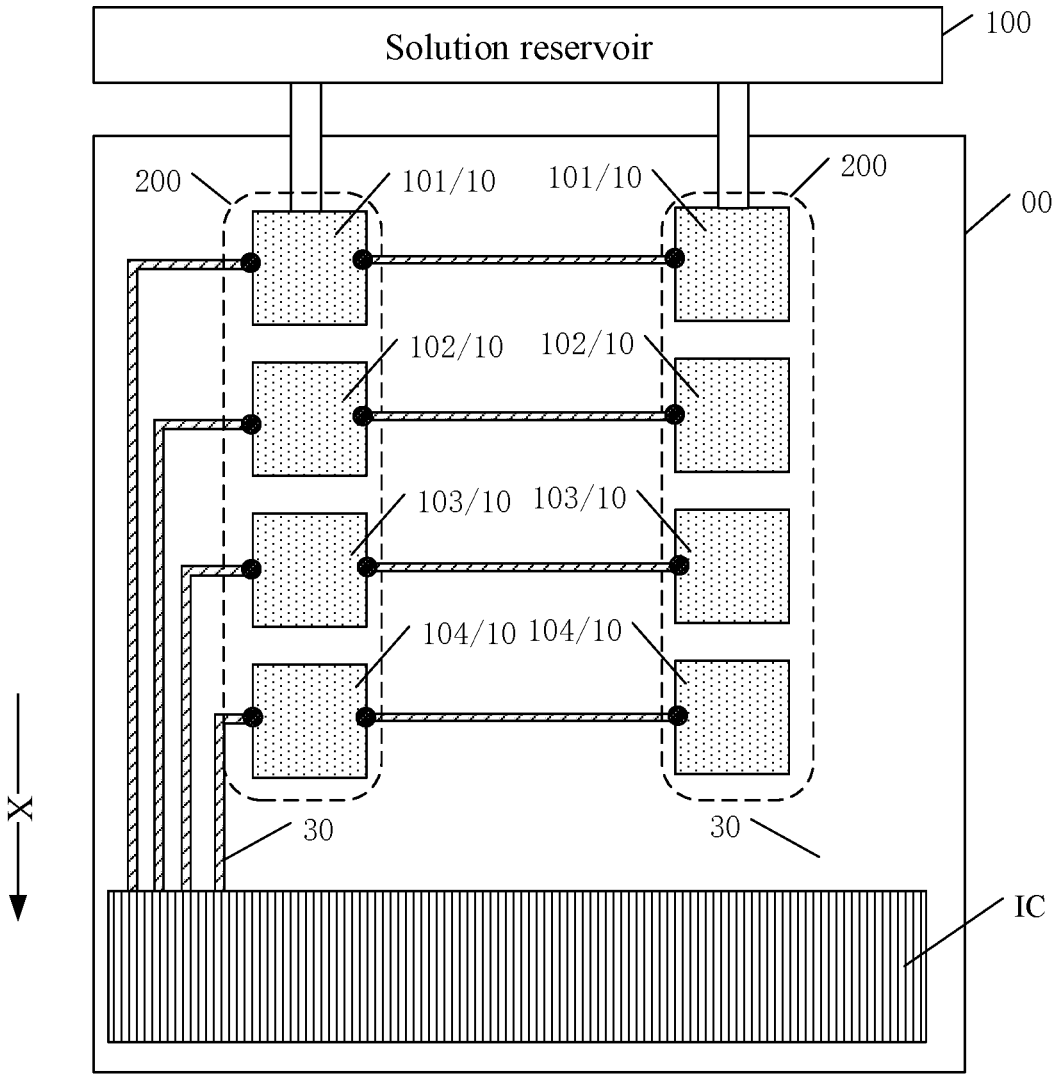
FIG. 15 illustrates a schematic plan view of another electrowetting panel according to some embodiments of the present disclosure.

FIG. 15 illustrates a schematic plan view of another electrowetting panel according to some embodiments of the present disclosure. Referring to FIGS. 14-15, different from the electrowetting panel shown in FIG. 14, the electrowetting panel shown in FIG. 15 may include one-to-one electrical connections between the driving electrodes 10 of one electrode group 200 and the driving electrodes 10 of the other electrode group 200. That is, the driving electrodes 10 of one electrode group 200 may be electrically connected to the driving electrodes 10 of the other electrode group 200 in a one-to-one correspondence. Therefore, the chip IC may be able to simultaneously transmit electrical signals to two driving electrodes 10 in the two electrode groups 200 through one signal line 30. As such, on the one hand, the two electrode groups 200 may be able to simultaneously drive droplets, so that the operation efficiency may be improved; and on the other hand, the number of pins in the chip IC that are electrically connected to the signal lines 30 may be reduced, and thus the design of the chip IC may be simplified, and the cost may be reduced.

It should be understood that reducing the number of the pins in the chip IC that are electrically connected to the signal lines 30 may be implemented through various manners. For example, a multiplex circuit may be disposed between the signal lines 30 and the pins of the chip IC, so that the number of the pins in the chip IC that are electrically connected to the signal lines can be reduced. The method for reducing the number of the pins in the chip IC that are electrically connected to the signal lines may be determined according to actual needs, and will not be further described in the present disclosure.

Figure 16:
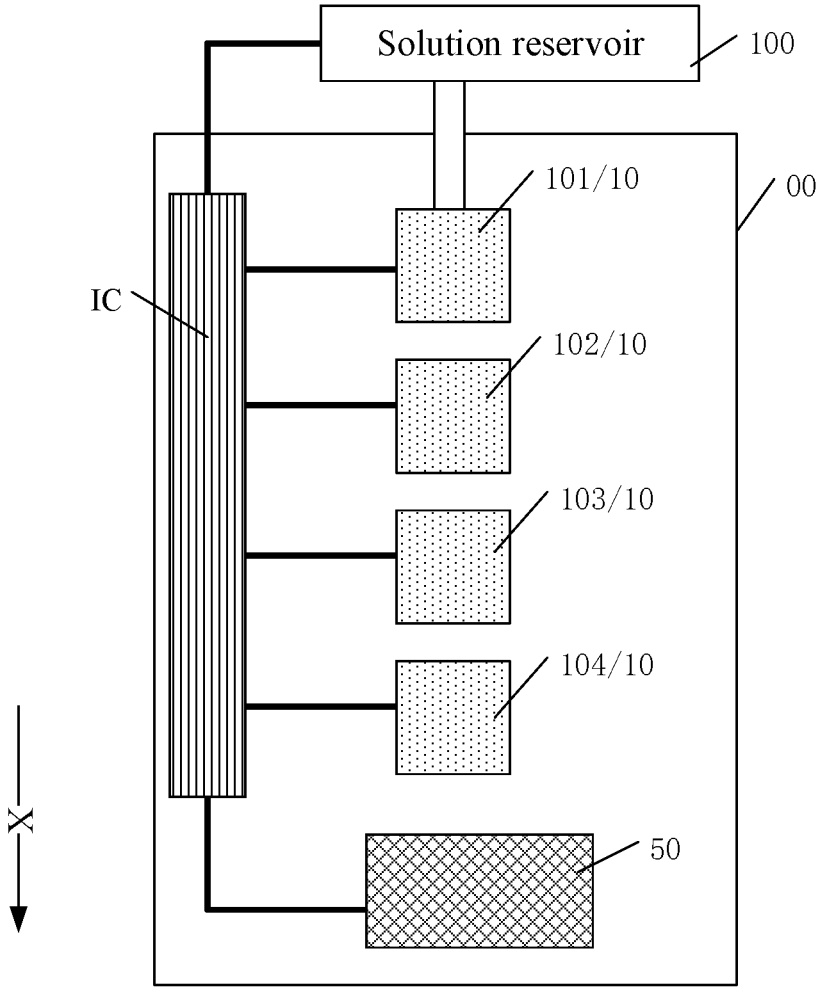
FIG. 16 illustrates a schematic plan view of another electrowetting panel according to some embodiments of the present disclosure.
Figure 17:
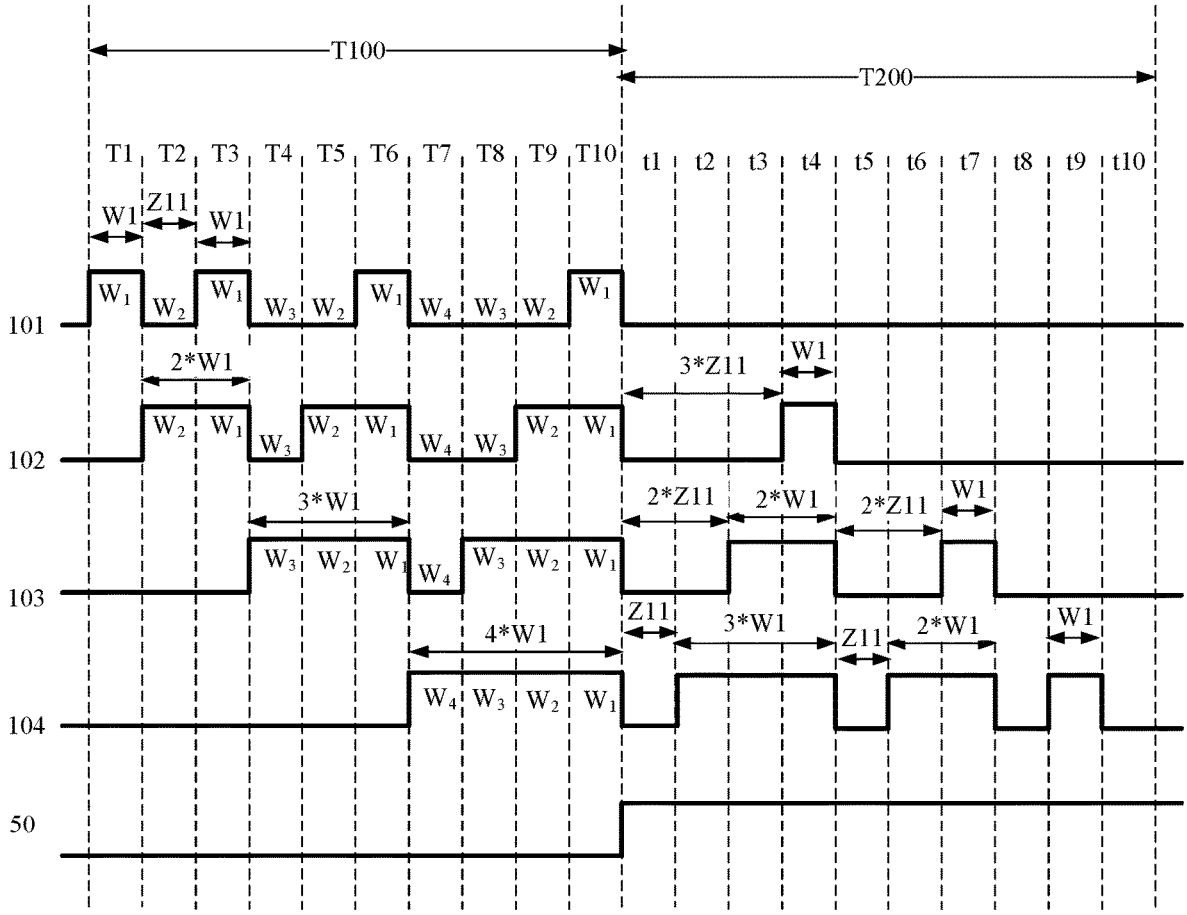
FIG. 17 illustrates a driving sequence diagram of driving voltages of another exemplary driving method for an electrowetting panel according to some embodiments of the present disclosure.

FIG. 16 illustrates a schematic plan view of another electrowetting panel according to some embodiments of the present disclosure, and FIG. 17 illustrates a driving sequence diagram of driving voltages of another exemplary driving method for an electrowetting panel according to some embodiments of the present disclosure. Referring to FIGS. 16-17, in one embodiment, the electrowetting panel may also include a recovery electrode 50. The recovery electrode 50 may be located on the side of the $M^{th}$ driving electrode 10 away from the $1^{st}$ driving electrode 10.

The driving method may include, during a droplet recovery period T200, providing a driving signal to the recovery electrode 50, providing a non-driving signal to the $1^{st}$ driving electrode 101, and providing a driving signal with a pulse width Wm to the $m^{th}$ driving electrode 10. The pulse width Wm of the driving signal of the $m^{th}$ driving electrode 10 may form a descending sequence with $Wm=(m\times W1)-(n\times W1)$, where n is a positive integer, and $1\leq n\leq m-1$. The pulse width of the non-driving signal between two adjacent driving signals of the $m^{th}$ driving electrode 10 may be Zm with $Zm=(M-m+1)\times Z11$.

For the $m^{th}$ driving electrode 10, the pulse width of the non-driving signal between the last driving signal of the droplet moving period T100 and the first driving signal of the droplet recovery period T200 may be Ym with $Ym=(M-m+1)\times Z11$.

In one embodiment, as an example, the electrowetting panel is described to include M=4 driving electrodes 10 for illustration. That is, the $M^{th}$ driving electrode 10 may be the $4^{th}$ driving electrode 104.

It should be noted that, the driving method shown in FIGS. 3, 5, and 7 only illustrates the electrical signals of the driving electrodes 10 during the droplet moving period T100.

In the following, schematic illustration of the electrical signals of the driving electrodes 10 during the droplet recovery period T200 will be provided.

In one embodiment, the droplets may be sequentially recovered back to the region where the recovery electrode 50 is located. For example, referring to FIG. 17, each of the driving electrodes may sequentially experience period t1 through period t10 to completely recover the droplets back to the region where the recovery electrode 50 is located.

In one embodiment, corresponding to a same driving electrode 10, the pulse widths of different driving signals during the droplet recovery period T200 may be different. For example, the pulse width of the driving signal of the $2^{nd}$ driving electrode 102 may be W1; the pulse widths of the driving signals of the $3^{rd}$ driving electrode 103 may be 2×W1, and W1, respectively; and the pulse widths of the driving signals of the $4^{th}$ driving electrode 104 may be 3×W1, 2×W1, and W1, respectively.

In one embodiment, corresponding to a same driving electrode 10, the pulse widths of different non-driving signals between adjacent driving signals may be the same. For example, the pulse width of each non-driving signal between two adjacent driving signals of the $3^{rd}$ driving electrode 103 may be 2×W1; and the pulse width of each non-driving signal between two adjacent driving signals of the $4^{th}$ driving electrode 104 may be W1.

For the $2^{nd}$ driving electrode 102, the pulse width of the non-driving signal between the last driving signal during the droplet moving period T100 and the first driving signal during the droplet recovery period T200 may be 3×Z11. For the $3^{rd}$ driving electrode 103, the pulse width of the non-driving signal between the last driving signal during the droplet moving period T100 and the first driving signal during the droplet recovery period T200 may be 2×Z11. For the $4^{th}$ driving electrode 104, the pulse width of the non-driving signal between the last driving signal during the droplet moving period T100 and the first driving signal during the droplet recovery period T200 may be Z11.

According to the disclosed driving method, how to recover the droplets is further provided. Therefore, the disclosed driving method shows high efficiency in droplet recovery, and thus the method is simple and highly efficient.

Figure 18:
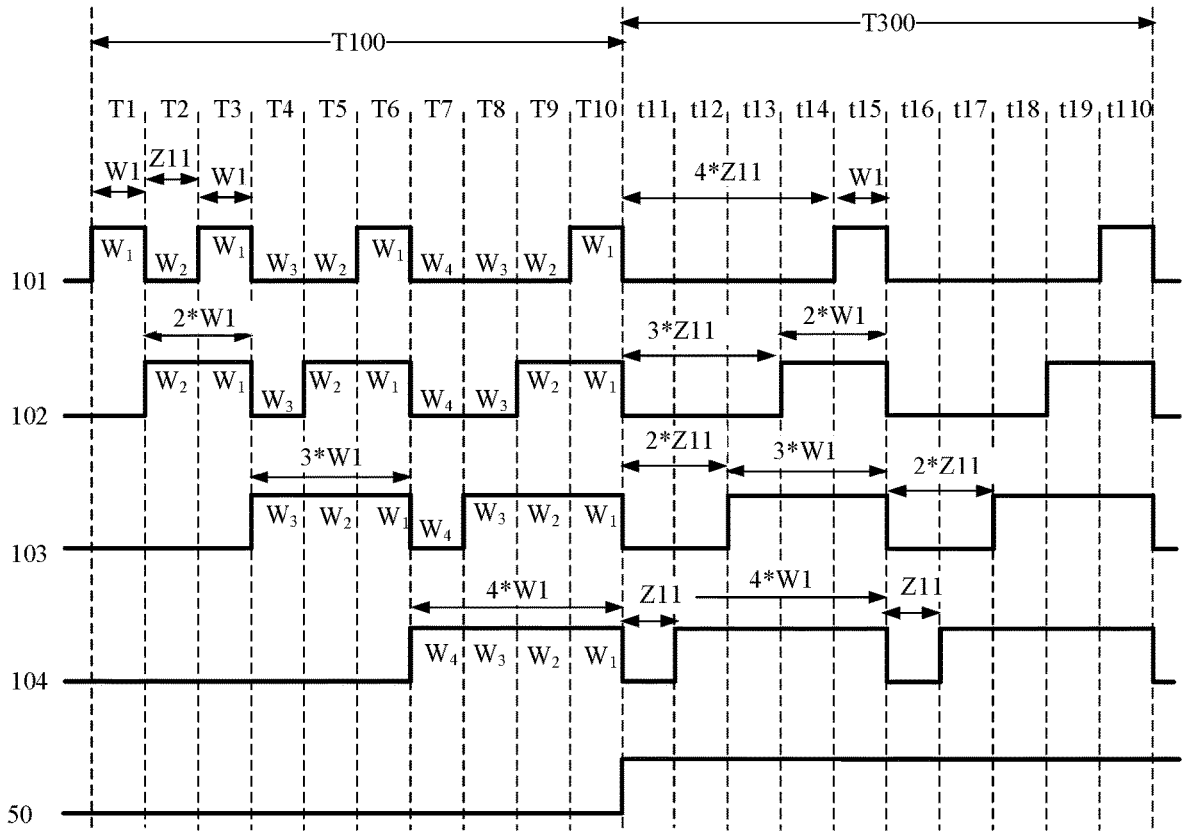
FIG. 18 illustrates a driving sequence diagram of driving voltages of another exemplary driving method for an electrowetting panel according to some embodiments of the present disclosure.

FIG. 18 illustrates a driving sequence diagram of driving voltages of another exemplary driving method for an electrowetting panel according to some embodiments of the present disclosure. Referring to FIGS. 16 and 18, during a droplet moving-and-recovery period T300, a driving signal may be provided to the recovery electrode 50. The pulse width of the driving signal of the $m^{th}$ driving electrode 10 may be Wm with $Wm=m\times W1$, and the pulse width of the non-driving signal between two adjacent driving signals of the $m^{th}$ driving electrode 10 may be Zm with $Zm=(M-m+1)\times Z11$.

In addition, for the $m^{th}$ driving electrode 10, the pulse width of the non-driving signal between the last driving signal during the droplet moving period T100 and the first driving signal during the droplet moving-and-recovery period T300 may be Ym with Ym=(M−m+1)×Z11.

In one embodiment, as an example, the electrowetting panel is described to include M=4 driving electrodes 10 for illustration. That is, the $M^{th}$ driving electrode 10 may be the $4^{th}$ driving electrode 104.

It should be noted that, the driving method shown in FIGS. 3, 5, and 7 only illustrates the electrical signals of the driving electrodes 10 during the droplet moving period T100.

In the following, schematic illustration of the electrical signals of the driving electrodes 10 during the droplet moving-and-recovery period T300 will be provided.

In one embodiment, the droplet moving-and-recovery period T300 may be used to sequentially recover the droplets back to the region where the recovery electrode 50 is located. In addition, new droplets may be simultaneously acquired from the solution reservoir and may be driven to move. For example, referring to FIG. 18, each of the driving electrodes 10 may sequentially experience period t11 through period t110 to completely recover the droplets acquired during the droplet moving period T100 back to the region where the recovery electrode 50 is located. At the same time, a new batch of droplets may be acquired from the solution reservoir to cover the M driving electrodes 10.

In one embodiment, corresponding to a same driving electrode 10, the pulse widths of different driving signals during the droplet recovery period T200 may be the same. For example, the pulse width of each driving signal of the $1^{st}$ driving electrode 101 may be W1; the pulse width of each driving signal of the $2^{nd}$ driving electrode 102 may be 2×W1; the pulse width of each driving signal of the $3^{rd}$ driving electrode 103 may be 3×W1; and the pulse width of each driving signal of the $4^{th}$ driving electrode 104 may be 4×W1.

In one embodiment, corresponding to a same driving electrode 10, the pulse widths of different non-driving signals between adjacent driving signals may be the same. For example, the pulse width of the non-driving signal between two adjacent driving signals of the $1^{st}$ driving electrode 101 may be 4×W1; the pulse width of the non-driving signal between two adjacent driving signals of the $2^{nd}$ driving electrode 102 may be 3×W1; the pulse width of the non-driving signal between two adjacent driving signals of the $3^{rd}$ driving electrode 103 may be 2×W1; and the pulse width of the non-driving signal between two adjacent driving signals of the $4^{th}$ driving electrode 104 may be W1.

For the $1^{st}$ driving electrode 101, the pulse width of the non-driving signal between the last driving signal during the droplet moving period T100 and the first driving signal during the droplet moving-and-recovery period T300 may be 4×Z11. For the $2^{nd}$ driving electrode 102, the pulse width of the non-driving signal between the last driving signal during the droplet moving period T100 and the first driving signal during the droplet moving-and-recovery period T300 may be 3×Z11. For the $3^{rd}$ driving electrode 103, the pulse width of the non-driving signal between the last driving signal during the droplet moving period T100 and the first driving signal during the droplet moving-and-recovery period T300 may be 2×Z11. For the $4^{th}$ driving electrode 104, the pulse width of the non-driving signal between the last driving signal during the droplet moving period T100 and the first driving signal during the droplet moving-and-recovery period T300 may be Z11.

According to the disclosed driving method, how to recover the droplets and simultaneously acquire new droplets is further provided. The droplet moving-and-recovery period may be used to sequentially recover the droplets back to the region where the recovery electrode 50 is located, and also simultaneously acquire new droplets from the solution reservoir and drive the new droplets to move. Therefore, the disclosed driving method shows high efficiency in droplet driving and recovery, and thus improves the operation efficiency of the electrowetting panel.

Compared to existing driving methods for electrowetting panels, the disclosed driving method for electrowetting panels may be able to achieve at least the following beneficial effects.

According to the disclosed driving method for electrowetting panels, multiple droplets can be sequentially acquired from the solution reservoir, and the acquired multiple droplets may be simultaneously driven to move, such that the driving efficiency may be high. In addition, adopting the driving method according to the present disclosure, droplets may be able to cover m driving electrodes, where m is a positive integer in a range of 1≤m<M. The value of m may be determined according to the actual needs. Therefore, separately setting the electrical signals of the driving electrodes according to the value of m may not be necessary, and thus the driving method may be flexible.

Of course, any of the products embodying the present invention may not necessarily require to meet all of the technical effects described above at the same time.

The above detailed descriptions only illustrate certain exemplary embodiments of the present disclosure, and are not intended to limit the scope of the present disclosure. Those skilled in the art can understand the specification as whole and technical features in the various embodiments can be combined into other embodiments understandable to those persons of ordinary skill in the art. Any equivalent or modification thereof, without departing from the spirit and principle of the present disclosure, falls within the true scope of the present disclosure.

What is claimed is:

1. A driving method, comprising:

providing an electrowetting panel, including:

a base substrate, and

M driving electrodes disposed on the base substrate, wherein the M driving electrodes are sequentially arranged from a $1^{st}$ driving electrode to an $M^{th}$ driving electrode along a first direction; and providing electrical signals to the M driving electrodes, such that the $1^{st}$ driving electrode acquires a droplet from a solution reservoir, and the M driving electrodes drive the droplet to move, wherein:

during a droplet moving period, a pulse width of a driving signal of an $m^{th}$ driving electrode is Wm with $$Wm = \sum_{i=1}^{m} W_i,$$

a pulse width of a non-driving signal between an $a^{th}$ driving signal and an $(a+1)^{th}$ driving signal of the $m^{th}$ driving electrode is Zma with $$Zma = \sum_{i=m+1}^{m+a} W_i,$$

an end time of a $1^{st}$ driving signal of the $m^{th}$ driving electrode and an end time of an $m^{th}$ driving signal of the $1^{st}$ driving electrode are same, and M, m, and a are positive integers, $1 \le m \le M$, and $M \ge 3$.

2. The driving method according to claim 1, wherein:

a pulse width of a driving signal of the $1^{st}$ driving electrode is W1, and a pulse width of a non-driving signal between a $1^{st}$ driving signal and a $2^{nd}$ driving signal of the $1^{st}$ driving electrode is Z11, wherein W1=Z11; and the pulse width of the driving signal of the $m^{th}$ driving electrode is m×W1, and the pulse width of the non-driving signal between the $a^{th}$ driving signal and the $(a+1)^{th}$ driving signal of the $m^{th}$ driving electrode is a×Z11.

3. The driving method according to claim 2, wherein:

the electrowetting panel further includes a recovery electrode, wherein:

the recovery electrode is located on a side of the $M^{th}$ driving electrode away from the 1st driving electrode.

4. The driving method according to claim 3, further including:

during a droplet recovery period, providing a driving signal to the recovery electrode, providing a non-driving signal to the $1^{st}$ driving electrode, and providing a driving signal to the $m^{th}$ driving electrode, wherein:

a pulse width of the driving signal of the $m^{th}$ driving electrode is Wm with Wm=(m×W1)−(n×W1), where n is a positive integer, and $1 \le n \le m-1$; and a pulse width of a non-driving signal between two adjacent driving signals of the $m^{th}$ driving electrode is Zm with Zm=(M−m+1)×Z11; and for the $m^{th}$ driving electrode, a pulse width of a non-driving signal between a last driving signal of the droplet moving period and a first driving signal of the droplet recovery period is Ym with Ym=(M−m+1)×Z11.

5. The driving method according to claim 3, further including:

during a droplet moving-and-recovery period, providing a driving signal to the recovery electrode, and providing a driving signal to the $m^{th}$ driving electrode, wherein:

a pulse width of the driving signal of the $m^{th}$ driving electrode is Wm with Wm=m×W1; and a pulse width of a non-driving signal between two adjacent driving signals of the $m^{th}$ driving electrode is Zm with Zm=(M−m+1)×Z11; and for the $m^{th}$ driving electrode, a pulse width of a non-driving signal between a last driving signal of the droplet moving period and a first driving signal of the droplet moving-and-recovery period is Ym with Ym=(M−m+1)×Z11.

6. The driving method according to claim 1, wherein:

a driving signal of any driving electrode of the M driving electrodes is a high level pulse signal.

7. The driving method according to claim 6, wherein:

the electrowetting panel further includes one or more auxiliary electrodes located between adjacent driving electrodes of the M driving electrodes; and the driving method includes providing electrical signals to the one or more auxiliary electrodes to assist the droplet to move, wherein:

a pulse width of a driving signal of each auxiliary electrode of the one or more auxiliary electrodes is X0, and a pulse width of a non-driving signal between two driving signals of each auxiliary electrode of the plurality of auxiliary electrodes is Y0, wherein X0+Y0=W1.

8. The driving method according to claim 7, wherein:

an auxiliary electrode of the one or more auxiliary electrodes is disposed between every two adjacent driving electrodes of the M driving electrodes, and the one or more auxiliary electrodes are electrically connected to each other.

9. The driving method according to claim 1, wherein:

each driving electrode of the M driving electrodes has a long strip shape extending along a second direction, wherein the second direction intersects the first direction;

T channels are disposed between the $1^{st}$ driving electrode and the solution reservoir, where T is a positive integer and $T \ge 2$; and the driving method further includes acquiring T droplets by the $1^{st}$ driving electrode.

10. The driving method according to claim 9, wherein:

each driving electrode of the M driving electrodes includes T sub-electrodes, and a connection bridge is disposed between every two adjacent sub-electrodes; and along the second direction, a width of the sub-electrodes is larger than a width of the connection bridge.

11. The driving method according to claim 1, wherein:

the electrowetting panel includes at least two electrode groups, wherein:

each electrode group of the at least two electrode groups includes the M driving electrodes arranged on the base substrate along the first direction.

12. The driving method according to claim 1, wherein:

the electrowetting panel further includes M signal lines, wherein:

the M signal lines are electrically connected to the M driving electrodes in a one-to-one correspondence.

13. The display panel according to claim 12, wherein:

the M signal lines and the M driving electrodes are formed in different conductive layers; and in a direction perpendicular to a plane of the M driving electrodes, a projection of the M signal lines partially overlaps with a projection of the M driving electrodes on the plane.

14. The driving method according to claim 12, wherein:

in a direction perpendicular to a plane in which the M driving electrodes are located, a projection of the M signal lines on the plane and a projection of the M driving electrodes on the plane are unoverlapped with each other.

15. The driving method according to claim 14, wherein:

the M signal lines and the M driving electrodes are located in a same conductive layer.

* * * * *